US007874532B2

(12) United States Patent
Mazzon

(10) Patent No.: US 7,874,532 B2
(45) Date of Patent: Jan. 25, 2011

(54) FOOT SUPPORT FOR VERTICALLY CHANGING THE INCLINE OF AN ELECTRIC GRILL APPARATUS

(75) Inventor: Renzo Mazzon, Silea (IT)

(73) Assignee: De'Longhi S.p.A., Treviso (IT)

( * ) Notice: Subject to any disclaimer, the term of this patent is extended or adjusted under 35 U.S.C. 154(b) by 157 days.

(21) Appl. No.: 12/293,871

(22) PCT Filed: Mar. 8, 2007

(86) PCT No.: PCT/EP2007/001994

§ 371 (c)(1),
(2), (4) Date: Sep. 22, 2008

(87) PCT Pub. No.: WO2007/107247

PCT Pub. Date: Sep. 27, 2007

(65) Prior Publication Data

US 2009/0114782 A1 May 7, 2009

(30) Foreign Application Priority Data

Mar. 22, 2006 (IT) ..... MI2006A0524

(51) Int. Cl.
*F16M 11/24* (2006.01)
*A47B 91/02* (2006.01)

(52) U.S. Cl. ..... 248/188.8; 248/188.2; 248/677

(58) Field of Classification Search ..... 248/188.2, 248/188.8, 677
See application file for complete search history.

(56) References Cited

U.S. PATENT DOCUMENTS

| | | | | | |
|---|---|---|---|---|---|
| 2,147,909 | A | * | 2/1939 | Mafera | 254/104 |
| 2,683,277 | A | * | 7/1954 | Bernaerts | 16/18 R |
| 2,816,685 | A | * | 12/1957 | Schaeffer | 220/632 |
| 2,933,754 | A | | 4/1960 | Winans | |
| 3,452,663 | A | * | 7/1969 | Machtig | 248/187.1 |
| 3,486,629 | A | * | 12/1969 | Slaga | 211/1.51 |
| 3,954,244 | A | * | 5/1976 | Gopstein | 248/349.1 |
| 4,073,454 | A | * | 2/1978 | Sauber | 248/188.2 |
| 4,763,868 | A | * | 8/1988 | Teich | 248/558 |
| 5,823,488 | A | * | 10/1998 | Nettekoven | 248/118 |
| 7,520,483 | B2 | * | 4/2009 | Rand et al. | 248/346.11 |

* cited by examiner

*Primary Examiner*—Terrell Mckinnon
*Assistant Examiner*—Chiedu A Chibogu
(74) *Attorney, Agent, or Firm*—Volpe and Koenig, P.C.

(57) ABSTRACT

A support foot of an electric grill for the cooking of food products is provided. The support foot includes a height regulator, including a first fixed foot portion suitable for rigid connection to the grill's body, and a second orientable foot portion suitable for supporting the grill on a support plane, the first and respectively second foot portions being hinged one to the other along a hinging axis tilted in relation to the support plane.

13 Claims, 3 Drawing Sheets

FOOT SUPPORT FOR VERTICALLY CHANGING THE INCLINE OF AN ELECTRIC GRILL APPARATUS

The present invention refers to a support foot structure of an electric grill for the cooking of food products and the electric grill that mounts such a support foot.

It is important that electric grills flexibly adjust from time to time to the type of food to be cooked in order to optimise the cooking.

The orientation of the cooking plate in particular must preferably be horizontal when food to be cooked features a soft consistency, such as, for example, eggs, cheese, crepes, or preferably oblique when fat dissolved during the cooking must be drained from the food, such as, for example, for sausages and the likes.

Traditional grills in general feature an tiltable cooking plate support system which, while allowing the adjustment of the cooking plate's position to the type of food to be cooked, sometimes presents however the disadvantage of excessive structural and functional complexity.

The technical task of the present invention is to, therefore, make a support foot structure of an electric grill for the cooking of food products and an electric grill that mounts such a support foot, which allow eliminating the technical disadvantages of the known art.

Within the scope of this technical task, one object of the invention is to make a support foot structure of an electric grill for the cooking of food products which allows flexibly adjusting the grill to the cooking of food presenting a different liquid and/or fat consistency.

Another object of the invention is to make a support foot structure of an electric grill for the cooking of food products which allows flexibly adjusting the grill to the cooking of food presenting a different liquid and/or fat consistency, while being simple, efficient and reliable in terms of its structure and its operating mode.

The technical task, as well as these other objects, according to the present invention, are achieved by making a support foot of an electric grill for the cooking of food products comprising means of regulation of its height, characterised in that said means of regulation comprise a first fixed foot portion suitable for rigid connection to the body of said grill, and a second orientable foot portion suitable for supporting such grill on a support plane, said first and respectively second foot portions being hinged one to the other along a hinging axis tilted in relation to said support plane.

The configuration of the foot is advantageously modifiable through the rotation of the orientable foot portion, which determines a variation of its height.

Furthermore, other characteristics of the present invention are defined in the following claims.

Further characteristics and advantages of the invention will be more obvious from the description of a preferred but not exclusive embodiment of the support foot of an electrical grill for the cooking of food according to the invention, depicted by way of example and not limitation in the accompanying drawings, in which.

Figure 1:
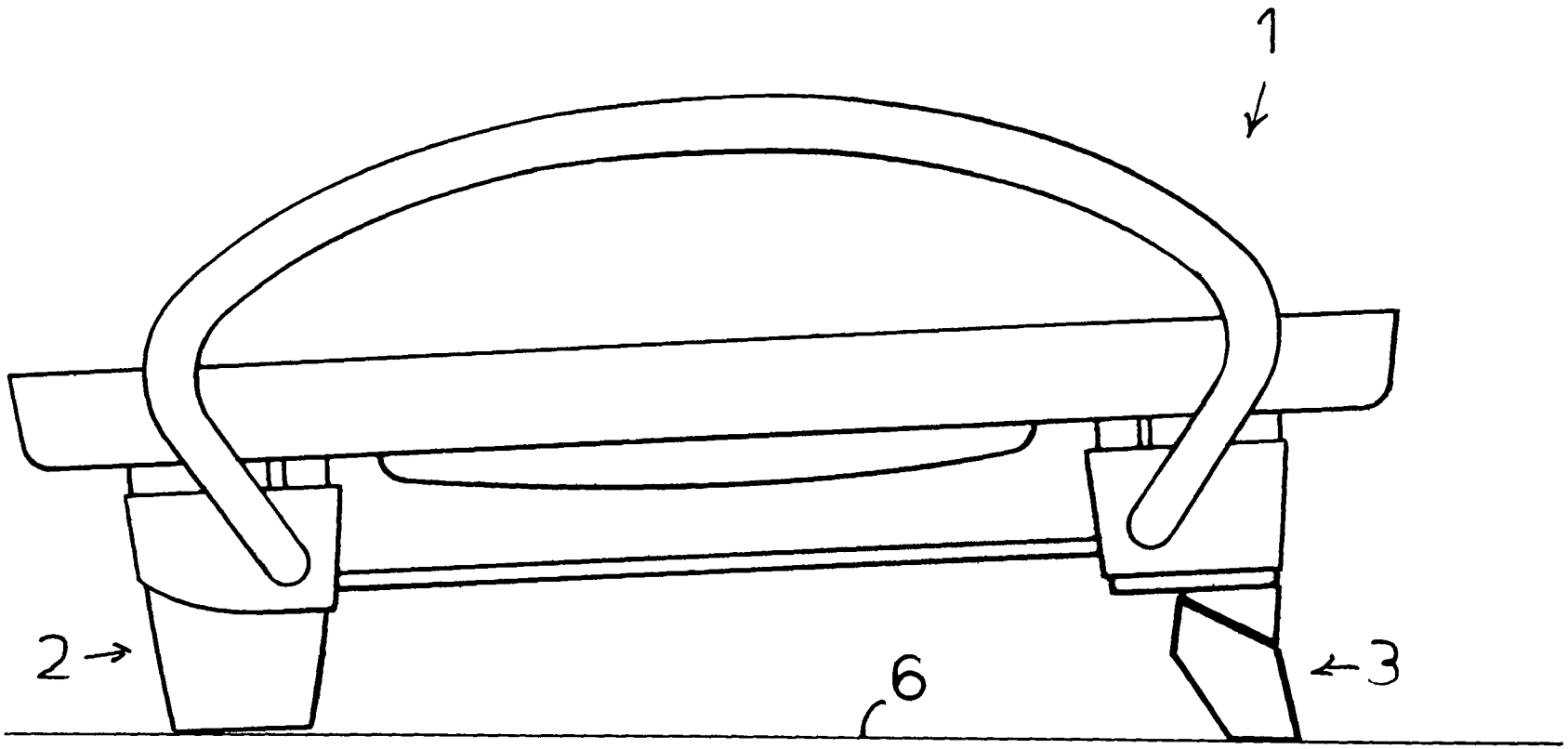
FIG. 1 shows a side elevation view of the grill with the back feet in the greater height configuration.
Figure 2:
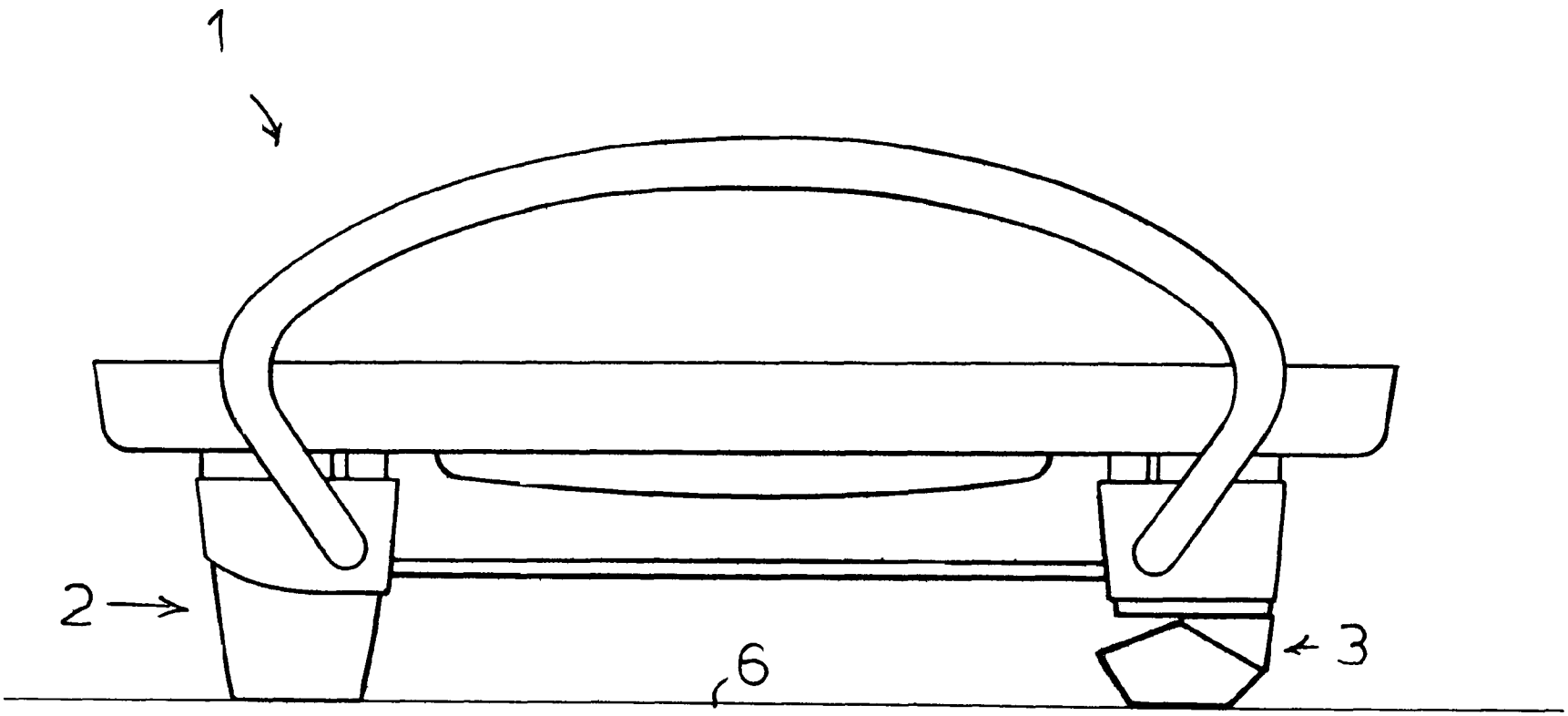
FIG. 2 shows a side elevation view of the grill of FIG. 1 with the back feet in the lower height configuration.
Figure 3:
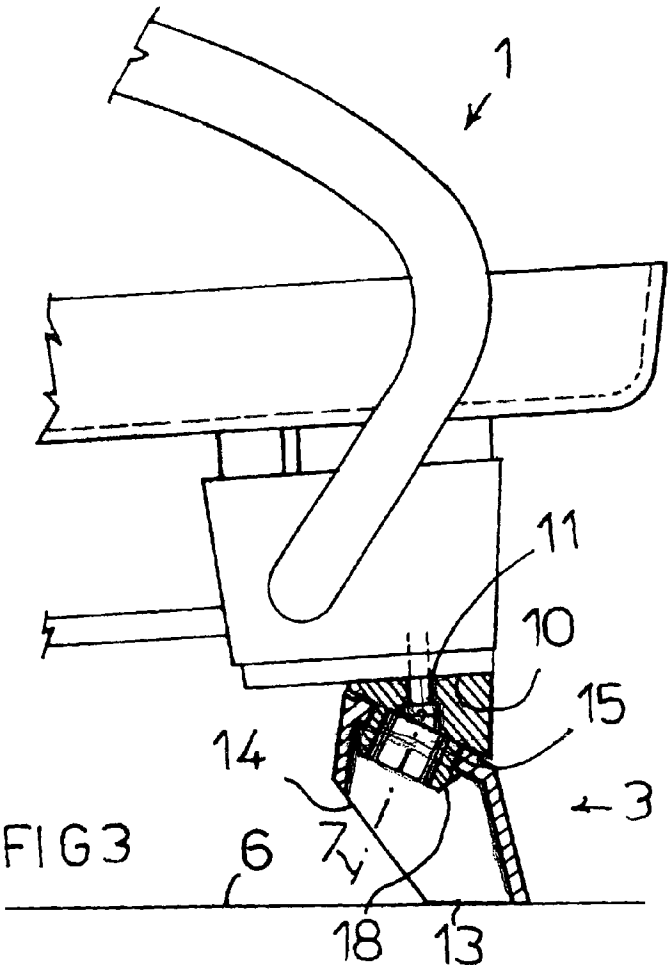
FIG. 3 shows a sectional view of a back foot of the grill of FIG. 1.
Figure 4:
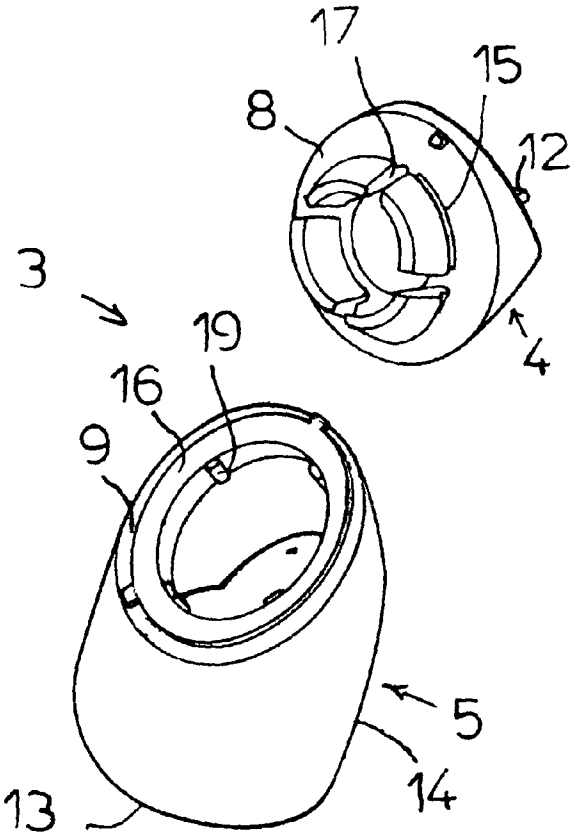
FIG. 4 shows a perspective view of a back foot of the grill of FIG. 1 in exploded configuration.

Referring to the mentioned figures, an electric grill for the cooking of food indicated altogether by reference numeral 1 is shown schematically. The grill 1 features front 2 and back 3 support feet of which at least one, in particular, for example, each back foot 3, features means of regulation of its height.

The means of regulation of foot 3 comprise a first fixed food portion 4 suitable for rigid connection to the body of the grill 1, and a second orientable foot portion 5 suitable for supporting the grill on a support plane 6.

The fixed foot portion 4 and the orientable foot portion 5 are hinged one to the other along a hinging axis 7 tilted in relation to the support plane 6.

The fixed foot portion 4 and the orientable foot portion 5 are further in contact at overlapped flat bases 8, 9 oriented orthogonally to the hinging axis 7.

Preferably, the flat contact bases 8, 9 present the same shape and dimension, in particular, they are circular.

The hinging axis 7 features a tilt of preferably 45° in relation to support plane 6.

The fixed foot portion 4 features a flat base 10 for fixing to the body of the grill 1, oriented in parallel to the support plane 6.

The flat base 10 features a central seat 11 for a screw for fixing to the body of the grill 1, and eccentric positioning teeth 12 engaging into corresponding locking seats formed in the body of the grill 1 to ensure that the fixed foot portion 4 is locked to the body of the grill 1 with the correct orientation.

The orientable foot portion 5 features first and respectively second flat support bases 13 and 14 on the support plane 6.

The first and second support bases 13 and 14 are contiguous and tilted one to the other with a preferably obtuse angle, and are selectively orientable in parallel to the support plane 6.

The shape of the fixed foot portion 4 derives from a solid of revolution, in this particular case a frustoconical section, featuring a straight base (that is orthogonal to the axis of the solid of revolution) and an oblique base (i.e. tilted in relation to the axis of the solid of revolution).

The axis of the solid of revolution from which the fixed foot portion 4 derives is vertical.

The shape of the orientable foot portion 5 derives from a faceted solid of revolution, in this particular case a hollow frustoconical section, featuring a straight base (i.e. orthogonal to the axis of the solid of revolution), an oblique base (i.e. tilted in relation to the axis of the solid of revolution) and faceting made with a sectioning plane obliquely cutting the solid of revolution between its lateral surface and its straight base.

In particular, the oblique base of the solid of revolution defines the base 9 of the orientable foot portion 5, the residual portion of the straight base of the solid of revolution defines the first support base 13 of the orientable foot portion 5, and the faceting defines the second support base 14 of the orientable foot portion 5.

In this way, when the first support base 13 is oriented in parallel to the support plane 6, the axis of the solid of revolution lies vertically and the foot features a maximum height, whereas when the second support base 14 is oriented in parallel to support plane 6, the axis of the solid of revolution is tilted and the foot reduces its height.

The solids of revolution from which the fixed 4 and orientable 5 foot portions derive, preferably when they lie with a vertical axis, result in being coaxial and on each other's extension.

The regulation of the foot from the configuration in which the first support base 13 is parallel to the support plane 6 to the configuration in which the second support base 14 is parallel to the support plane 6 and vice-versa occurs through 180° rotation of the orientable foot portion 5 in relation to the hinging axis 7.

The fixed foot portion 4 and the orientable foot portion 5 are united through a rotation joint comprising a ring-shaped male connection element 15 connected to a female connection element 16 of matching form, each present at one the bases 8, 9 of coupling between the fixed foot portion 4 and the orientable foot portion 5.

The male connection element 15 is made radially elastically pliable through diametrically aligned slits 17, which extend along its full axial extension. The male connection element 15 further features a hook-shaped head 18 for its snap anchoring to the female connection element 16.

The lateral surface of the female connection element 16, facing the male connection element 15, features rotation locking elements of the orientable foot portion 5 when the first and second support bases 13 and 14 are oriented in parallel to the support plane 6.

The locking elements comprise projections 19 for engagement into the slits 17.

The operation of the support foot according to the invention appears obvious from what is described and depicted and, in particular, is essentially the following.

When the cooking plate must take a horizontal position, the back feet 3 are brought to the same length as the front support feet 2 through a rotation of the orientable foot portion 5 which brings the first support base 13 in parallel to the support plane 6.

On the other hand, when the cooking plate must take a tilted position, the back feet 3 are brought to a different length from the front support feet 2 through a reverse rotation of the orientable foot portion 5 which brings the second support base 14 in parallel to the support plane 6.

During the rotation, the projections 19 disengage from the slits 17 thanks to the elasticity of the male connection element 15, then slide along the lateral surface of the female connection element 16, and finally engage, always thanks to the elasticity of the male connection element 15, into the slits 17 that they encounter in a position diametrically opposite that of the start.

The support foot of an electric grill for the cooking of food thus conceived is subject to numerous modifications and variations, all of which fall under the scope of the inventive concept; furthermore, all details may be replaced by technically equivalent elements.

In practice, all materials used, as well as the dimensions, may be anything depending on needs and on the state of the art.

The invention claimed is:

1. Support foot of an electric grill for the cooking of food products comprising a height regulator comprising, a first fixed foot portion suitable for rigid connection to said grill, and a second orientable foot portion suitable for supporting said grill on a support plane, said first fixed foot portion and second orientable foot portion being hinged one to the other along a hinging axis tilted in relation to said support plane, the second orientable foot portion having first and respectively second flat support bases to support said second orientable foot portion on said support plane, said first and second flat support bases being tilted one to the other and selectively orientable in parallel relation to said support plane.

2. Support foot of an electric grill for the cooking of food products according to claim 1, wherein said first fixed foot portion and second orientable foot portion each comprise a respective overlapped flat base, wherein each overlapped flat base is oriented orthogonally to said hinging axis, wherein said overlapped flat bases overlap one another and are in contact with one another.

3. Support foot of an electric grill for the cooking of food products according to claim 2, wherein said overlapped flat bases have the same shape and size.

4. Support foot of an electric grill for the cooking of food products according to claim 2, wherein said overlapped flat bases are circular.

5. Support foot of an electric grill for the cooking of food products according to claim 2, wherein said hinging axis has a 45° tilt in relation to said support plane.

6. Support foot of an electric grill for the cooking of food products according to claim 1, wherein said first fixed foot portion has a flat base for fixing said fixed foot portion to said grill, and wherein said flat base is disposed in parallel alignment with said support plane.

7. Support foot of an electric grill for the cooking of food products according to claim 1, wherein said first and second flat support bases are contiguous and tilted one to the other at an obtuse angle.

8. Support foot of an electric grill for the cooking of food products according to claim 1, wherein said first and second flat support bases are orientable in parallel relation to said support plane through 180° rotation of said second orientable foot portion in relation to said hinging axis.

9. Support foot of an electric grill for the cooking of food products according to claim 2, wherein said first fixed foot portion and second orientable foot portion are coupled to one another via a rotation joint comprising a ring-shaped male connection element connected to a female connection element of matching form, said male connection element and said female connection element each being provided on a corresponding one of said overlapped flat bases between said first fixed foot portion and second orientable foot portion.

10. Support foot of an electric grill for the cooking of food products according to claim 9, wherein said male connection element is made radially elastically pliable through slits which extend along a full axial extension of said male connection element.

11. Support foot of an electric grill for the cooking of food products according to claim 9, wherein said male connection element features a hook-shaped head for snap fixing said male connection element to said female connection element.

12. Support foot of an electric grill for the cooking of food products according to claim 10, wherein said female connection element comprises a lateral surface, said lateral surface facing said male connection element, wherein rotation locking elements are provided on said lateral surface, and said rotation locking elements locking said second orientable foot portion when said first and respectively second flat support bases are oriented in said parallel relation to said support plane.

13. Support foot of an electric grill for the cooking of food products according to claim 12, wherein said rotation locking elements comprise projections for engagement into said slits.

* * * * *